US012252985B2

(12) United States Patent
Saif et al.

(10) Patent No.: US 12,252,985 B2
(45) Date of Patent: Mar. 18, 2025

(54) BOREHOLE ACQUISITION OPERATION INTERVAL VIA STONELEY WAVE

(71) Applicants: Schlumberger Technology Corporation, Sugar Land, TX (US); Saudi Arabian Oil Company, Dhahran (SA)

(72) Inventors: Mohamed Saif, Dhahran (SA); Sachit Saumya, Dhahran (SA); Wael Abdallah, Dhahran (SA); Ramy Ahmed Mohamed, Al-Khobar (SA); Aida Abdullah Abri, Dhahran (SA); Shouxiang Mark Ma, Dhahran (SA)

(73) Assignees: SCHLUMBERGER TECHNOLOGY CORPORATION, Sugar Land, TX (US); SAUDI ARABIAN OIL COMPANY, Dhahran (SA)

( * ) Notice: Subject to any disclaimer, the term of this patent is extended or adjusted under 35 U.S.C. 154(b) by 217 days.

(21) Appl. No.: 18/058,939

(22) Filed: Nov. 28, 2022

(65) Prior Publication Data

US 2024/0175353 A1 May 30, 2024

(51) Int. Cl.
*E21B 49/00* (2006.01)
*E21B 49/08* (2006.01)

(52) U.S. Cl.
CPC ..... *E21B 49/005* (2013.01); *E21B 49/087* (2013.01)

(58) Field of Classification Search
CPC ..... E21B 49/005; E21B 49/087
See application file for complete search history.

(56) References Cited

U.S. PATENT DOCUMENTS 8,635,907 B2 * 1/2014 Bakulin ..... E21B 47/107 73/152.58
2019/0242221 A1 * 8/2019 Al-Ofi ..... E21B 43/025
2020/0370375 A1 * 11/2020 Gleitman ..... E21B 44/00

OTHER PUBLICATIONS

Kimball, C. V. et al., "Quantitative Stoneley Mobility Inversion", Paper presented at the 1998 SEG Annual Meeting, New Orleans, Louisiana, Sep. 1998, 4 pages.
Brie, A. et al., "Quantitative Formation Permeability Evaluation from Stoneley Waves", SPE-49131-MS, paper presented at the SPE Annual Technical Conference and Exhibition, New Orleans, Louisiana, 1998, 12 pages.

* cited by examiner

*Primary Examiner* — Jamel E Williams
(74) *Attorney, Agent, or Firm* — Jeffrey D. Frantz

(57) ABSTRACT

A method can include receiving Stoneley wave data acquired by a sonic tool disposed in a borehole in a formation; performing an inversion using the Stoneley wave data to generate formation and borehole information; and identifying an interval along the borehole for performance of a downhole acquisition operation by a downhole tool using a machine learning model and the formation and borehole information as input to the machine learning model.

17 Claims, 9 Drawing Sheets

600

BOREHOLE ACQUISITION OPERATION INTERVAL VIA STONELEY WAVE

BACKGROUND

A reservoir can be a subsurface formation that can be characterized at least in part by its porosity and fluid permeability. As an example, a reservoir may be part of a basin such as a sedimentary basin. A basin can be a depression (e.g., caused by plate tectonic activity, subsidence, etc.) in which sediments accumulate. As an example, where hydrocarbon source rocks occur in combination with appropriate depth and duration of burial, a petroleum system may be developed within a basin, which may form a reservoir that includes hydrocarbon fluids (e.g., oil, gas, etc.). Various operations may be performed in the field to access such hydrocarbon fluids and/or produce such hydrocarbon fluids. For example, consider equipment operations where equipment may be controlled to perform one or more operations. In such an example, control may be based at least in part on characteristics of rock where drilling into such rock forms a borehole that can be completed to form a well to produce from a reservoir and/or to inject fluid into a reservoir. While hydrocarbon fluid reservoirs are mentioned as an example, a reservoir that includes water or brine may be assessed, for example, for one or more purposes such as, for example, carbon storage (e.g., sequestration), water production or storage, geothermal production or storage, metallic extraction from brine, etc.

SUMMARY

A method can include receiving Stoneley wave data acquired by a sonic tool disposed in a borehole in a formation; performing an inversion using the Stoneley wave data to generate formation and borehole information; and identifying an interval along the borehole for performance of a downhole acquisition operation by a downhole tool using a machine learning model and the formation and borehole information as input to the machine learning model. A system can include one or more processors; memory accessible to at least one of the one or more processors; processor-executable instructions stored in the memory and executable to instruct the system to: receive Stoneley wave data acquired by a sonic tool disposed in a borehole in a formation; perform an inversion using the Stoneley wave data to generate formation and borehole information; and identify an interval along the borehole for performance of a downhole acquisition operation by a downhole tool using a machine learning model and the formation and borehole information as input to the machine learning model. One or more computer-readable storage media can include processor-executable instructions to instruct a computing system to: receive Stoneley wave data acquired by a sonic tool disposed in a borehole in a formation; perform an inversion using the Stoneley wave data to generate formation and borehole information; and identify an interval along the borehole for performance of a downhole acquisition operation by a downhole tool using a machine learning model and the formation and borehole information as input to the machine learning model. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

This description is not to be taken in a limiting sense, but rather is made merely for the purpose of describing the general principles of the implementations. The scope of the described implementations should be ascertained with reference to the issued claims.

Figure 1:
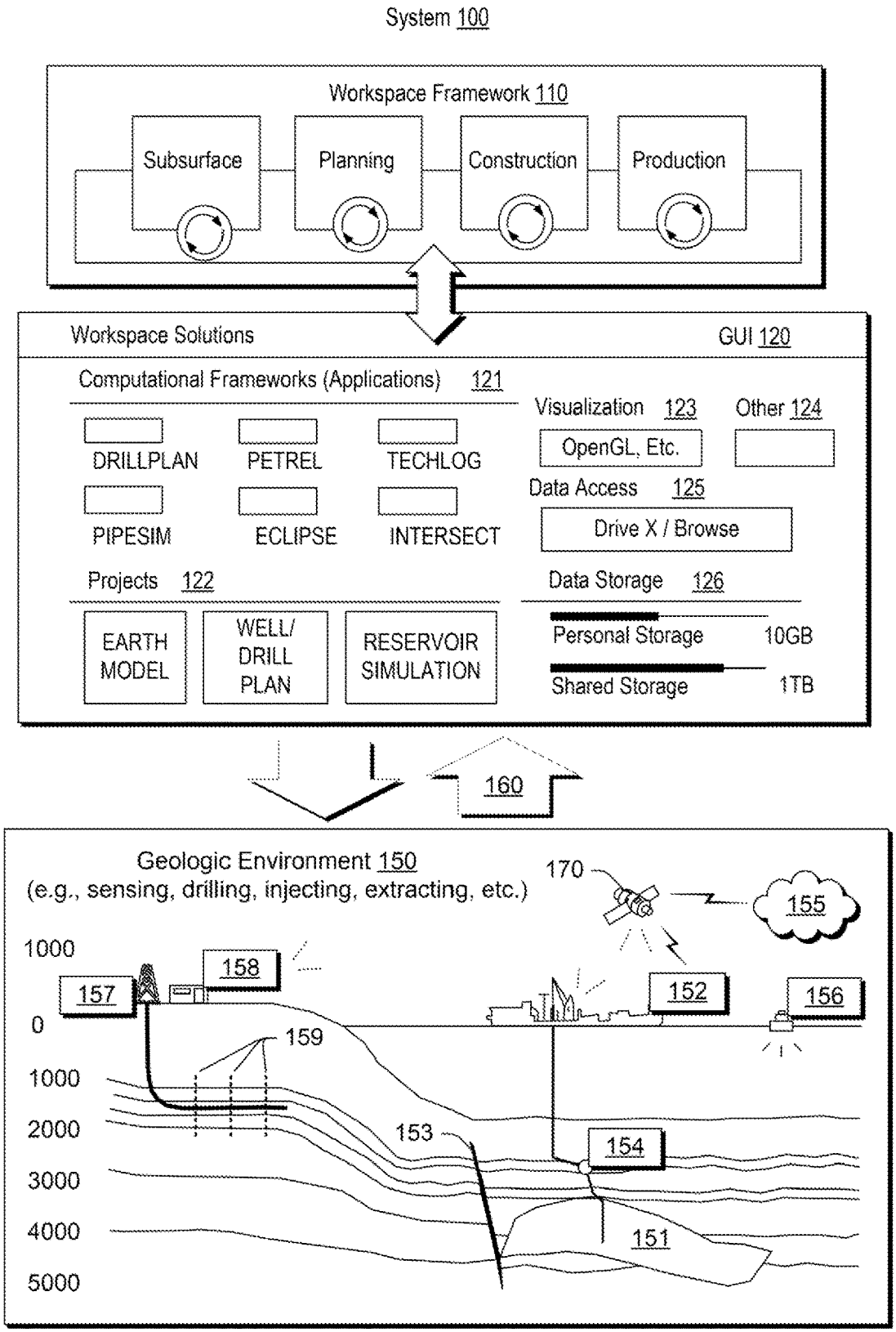
FIG. 1 illustrates an example system that includes various framework components associated with one or more geologic environments.

FIG. 1 shows an example of a system 100 that includes a workspace framework 110 that can provide for instantiation of, rendering of, interactions with, etc., a graphical user interface (GUI) 120. In the example of FIG. 1, the GUI 120 can include graphical controls for computational frameworks (e.g., applications) 121, projects 122, visualization 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. A geologic environment 150 may be outfitted with a variety of sensors, detectors, actuators, etc. In such an environment, various types of equipment such as, for example, equipment 152 may include communication circuitry to receive and to transmit information, optionally with respect to one or more networks 155. Such information may include information associated with downhole equipment 154, which may be equipment to acquire information, to assist with resource recovery, etc. Other equipment 156 may be located remote from a wellsite and include sensing, detecting, emitting, or other circuitry. Such equipment may include storage and communication circuitry to store and to communicate data, instructions, etc. One or more satellites may be provided for purposes of communications, data acquisition, etc. For example, FIG. 1 shows a satellite 170 in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a formation that may include natural fractures, artificial fractures (e.g., hydraulic fractures) or a combination of natural and artificial fractures. As an example, a well may be drilled for a reservoir that is laterally extensive. In such an example, lateral variations in rock and fluid properties, formation stresses, etc., may exist where an assessment of such variations may assist with planning, operations, etc., to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, PETREL, TECHLOG, PETROMOD, ECLIPSE, and INTERSECT frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The PETREL framework can be part of the DELFI cognitive exploration and production (E&P) environment (SLB, Houston, Texas, referred to as the DELFI environment) for utilization in geosciences and geoengineering, for example, to analyze subsurface data from exploration to production of fluid from a reservoir.

One or more types of frameworks may be implemented within or in a manner operatively coupled to the DELFI environment, which is a secure, cognitive, cloud-based collaborative environment that integrates data and workflows with digital technologies, such as artificial intelligence (AI) and machine learning (ML). Such an environment can provide for operations that involve one or more frameworks. The DELFI environment may be referred to as the DELFI framework, which may be a framework of frameworks. The DELFI environment can include various other frameworks, which may operate using one or more types of models (e.g., simulation models, etc.).

The TECHLOG framework can handle and process field and laboratory data for a variety of geologic environments (e.g., deepwater exploration, shale, etc.). The TECHLOG framework can structure wellbore data for analyses, planning, etc.

The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). The PIPESIM simulator may be an optimizer that can optimize one or more operational scenarios at least in part via simulation of physical phenomena.

The ECLIPSE framework provides a reservoir simulator with numerical solvers for prediction of dynamic behavior for various types of reservoirs and development schemes.

The INTERSECT framework provides a high-resolution reservoir simulator for simulation of geological features and quantification of uncertainties, for example, by creating production scenarios and, with the integration of precise models of the surface facilities and field operations, the INTERSECT framework can produce results, which may be continuously updated by real-time data exchanges (e.g., from one or more types of data acquisition equipment in the field that can acquire data during one or more types of field operations, etc.). The INTERSECT framework can provide completion configurations for complex wells where such configurations can be built in the field, can provide detailed chemical-enhanced-oil-recovery (EOR) formulations where such formulations can be implemented in the field, can analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI environment, for example, for rapid simulation of multiple concurrent cases.

The aforementioned DELFI environment provides various features for workflows as to subsurface analysis, planning, construction and production, for example, as illustrated in the workspace framework 110. As shown in FIG. 1, outputs from the workspace framework 110 can be utilized for directing, controlling, etc., one or more processes in the geologic environment 150, and feedback 160 can be received via one or more interfaces in one or more forms (e.g., acquired data as to operational conditions, equipment conditions, environment conditions, etc.).

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

Visualization features may provide for visualization of various earth models, properties, etc., in one or more dimensions. As an example, visualization features may include one or more control features for control of equipment, which can include, for example, field equipment that can perform one or more field operations. A workflow may utilize one or more frameworks to generate information that can be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. Seismic data may be processed and interpreted, for example, to understand better composition, fluid content, extent and geometry of subsurface rocks. Such interpretation results can be utilized to plan, simulate, perform, etc., one or more operations for production of fluid from a reservoir (e.g., reservoir rock, etc.). Field acquisition equipment may be utilized to acquire seismic data, which may be in the form of traces where a trace can include values organized with respect to time and/or depth (e.g., consider 1D, 2D, 3D or 4D seismic data).

A model may be a simulated version of a geologic environment where a simulator may include features for simulating physical phenomena in a geologic environment based at least in part on a model or models. A simulator, such as a reservoir simulator, can simulate fluid flow in a geologic environment based at least in part on a model that can be generated via a framework that receives seismic data. A simulator can be a computerized system (e.g., a computing system) that can execute instructions using one or more processors to solve a system of equations that describe physical phenomena subject to various constraints. While several simulators are illustrated in the example of FIG. 1, one or more other simulators may be utilized, additionally or alternatively.

Figure 2:
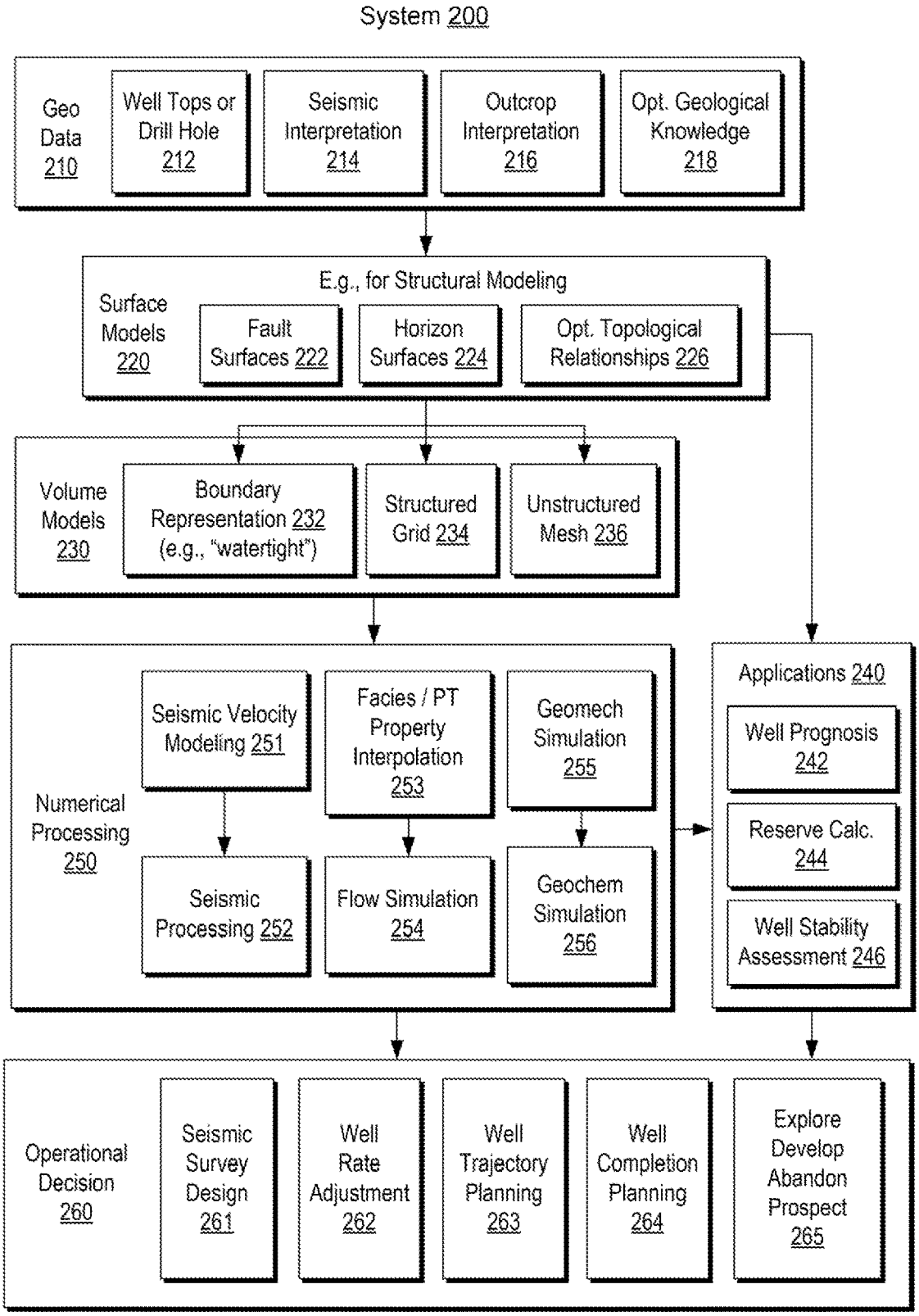
FIG. 2 illustrates an example of a system.

FIG. 2 shows an example of a system 200 that can be operatively coupled to one or more databases, data streams, etc. For example, one or more pieces of field equipment, laboratory equipment, computing equipment (e.g., local and/or remote), etc., can provide and/or generate data that may be utilized in the system 200.

As shown, the system 200 can include a geological/geophysical data block 210, a surface models block 220 (e.g., for one or more structural models), a volume modules block 230, an applications block 240, a numerical processing block 250 and an operational decision block 260. As shown in the example of FIG. 2, the geological/geophysical data block 210 can include data from well tops or drill holes 212, data from seismic interpretation 214, data from outcrop interpretation and optionally data from geological knowledge. As an example, the geological/geophysical data block 210 can include data from digital images, which can include digital images of cores, cuttings, outcrops, etc. As to the surface models block 220, it may provide for creation, editing, etc. of one or more surface models based on, for example, one or more of fault surfaces 222, horizon surfaces 224 and optionally topological relationships 226. As to the volume models block 230, it may provide for creation, editing, etc. of one or more volume models based on, for example, one or more of boundary representations 232 (e.g., to form a watertight model), structured grids 234 and unstructured meshes 236.

As shown in the example of FIG. 2, the system 200 may allow for implementing one or more workflows, for example, where data of the data block 210 are used to create, edit, etc. one or more surface models of the surface models block 220, which may be used to create, edit, etc. one or more volume models of the volume models block 230. As indicated in the example of FIG. 2, the surface models block 220 may provide one or more structural models, which may be input to the applications block 240. For example, such a structural model may be provided to one or more applications, optionally without performing one or more processes of the volume models block 230 (e.g., for purposes of numerical processing by the numerical processing block 250). Accordingly, the system 200 may be suitable for one or more workflows for structural modeling (e.g., optionally without performing numerical processing per the numerical processing block 250).

As to the applications block 240, it may include applications such as a well prognosis application 242, a reserve calculation application 244 and a well stability assessment application 246. As to the numerical processing block 250, it may include a process for seismic velocity modeling 251 followed by seismic processing 252, a process for facies and petrophysical property interpolation 253 followed by flow simulation 254, and a process for geomechanical simulation 255 followed by geochemical simulation 256. As indicated, as an example, a workflow may proceed from the volume models block 230 to the numerical processing block 250 and then to the applications block 240 and/or to the operational decision block 260. As another example, a workflow may proceed from the surface models block 220 to the applications block 240 and then to the operational decisions block 260 (e.g., consider an application that operates using a structural model).

In the example of FIG. 2, the operational decisions block 260 may include a seismic survey design process 261, a well rate adjustment process 252, a well trajectory planning process 263, a well completion planning process 264 and a process for one or more prospects, for example, to decide whether to explore, develop, abandon, etc. a prospect.

Referring again to the data block 210, the well tops or drill hole data 212 may include spatial localization, and optionally surface dip, of an interface between two geological formations or of a subsurface discontinuity such as a geological fault; the seismic interpretation data 214 may include a set of points, lines or surface patches interpreted from seismic reflection data, and representing interfaces between media (e.g., geological formations in which seismic wave velocity differs) or subsurface discontinuities; the outcrop interpretation data 216 may include a set of lines or points, optionally associated with measured dip, representing boundaries between geological formations or geological faults, as interpreted on the earth surface; and the geological knowledge data 218 may include, for example, knowledge of the paleo-tectonic and sedimentary evolution of a region.

As to a structural model, it may be, for example, a set of gridded or meshed surfaces representing one or more interfaces between geological formations (e.g., horizon surfaces) or mechanical discontinuities (fault surfaces) in the subsurface. As an example, a structural model may include some information about one or more topological relationships between surfaces (e.g. fault A truncates fault B, fault B intersects fault C, etc.).

As to the facies and petrophysical property interpolation 253, it may include an assessment of type of rocks and of their petrophysical properties (e.g., porosity, permeability), for example, optionally in areas not sampled by well logs or coring. As an example, such an interpolation may be constrained by interpretations from log and core data, and by prior geological knowledge.

As to the various applications of the applications block 240, the well prognosis application 242 may include predicting type and characteristics of geological formations that may be encountered by a drill bit, and location where such rocks may be encountered (e.g., before a well is drilled); the reserve calculations application 244 may include assessing total amount of hydrocarbons or ore material present in a subsurface environment (e.g., and estimates of which proportion can be recovered, given a set of economic and technical constraints); and the well stability assessment application 246 may include estimating risk that a well, already drilled or to-be-drilled, will collapse or be damaged due to underground stress.

As to the operational decision block 260, the seismic survey design process 261 may include deciding where to place seismic sources and receivers to optimize the coverage and quality of the collected seismic information while minimizing cost of acquisition; the well rate adjustment process 262 may include controlling injection and production well schedules and rates (e.g., to maximize recovery and production); the well trajectory planning process 263 may include designing a well trajectory to maximize potential recovery and production while minimizing drilling risks and costs; the well trajectory planning process 264 may include selecting proper well tubing, casing and completion (e.g., to meet expected production or injection targets in specified reservoir formations); and the prospect process 265 may include decision making, in an exploration context, to continue exploring, start producing or abandon prospects (e.g., based on an integrated assessment of technical and financial risks against expected benefits).

The system 200 can include and/or can be operatively coupled to a system such as the system 100 of FIG. 1. For example, the workspace framework 110 may provide for instantiation of, rendering of, interactions with, etc., the graphical user interface (GUI) 120 to perform one or more actions as to the system 200. In such an example, access may be provided to one or more frameworks (e.g., DRILLPLAN, PETREL, TECHLOG, PIPESIM, ECLIPSE, INTERSECT, etc.). One or more frameworks may provide for geo data acquisition as in block 210, for structural modeling as in block 220, for volume modeling as in block 230, for running an application as in block 240, for numerical processing as in block 250, for operational decision making as in block 260, etc.

As an example, the system 200 may provide for monitoring data, which can include geo data per the geo data block 210. In various examples, geo data may be acquired during one or more operations. For example, consider acquiring geo data during drilling operations via downhole equipment and/or surface equipment. As an example, the operational decision block 260 can include capabilities for monitoring, analyzing, etc., such data for purposes of making one or more operational decisions, which may include controlling equipment, revising operations, revising a plan, etc. In such an example, data may be fed into the system 200 at one or more points where the quality of the data may be of particular interest. For example, data quality may be characterized by one or more metrics where data quality may provide indications as to trust, probabilities, etc., which may be germane to operational decision making and/or other decision making.

Figure 3:
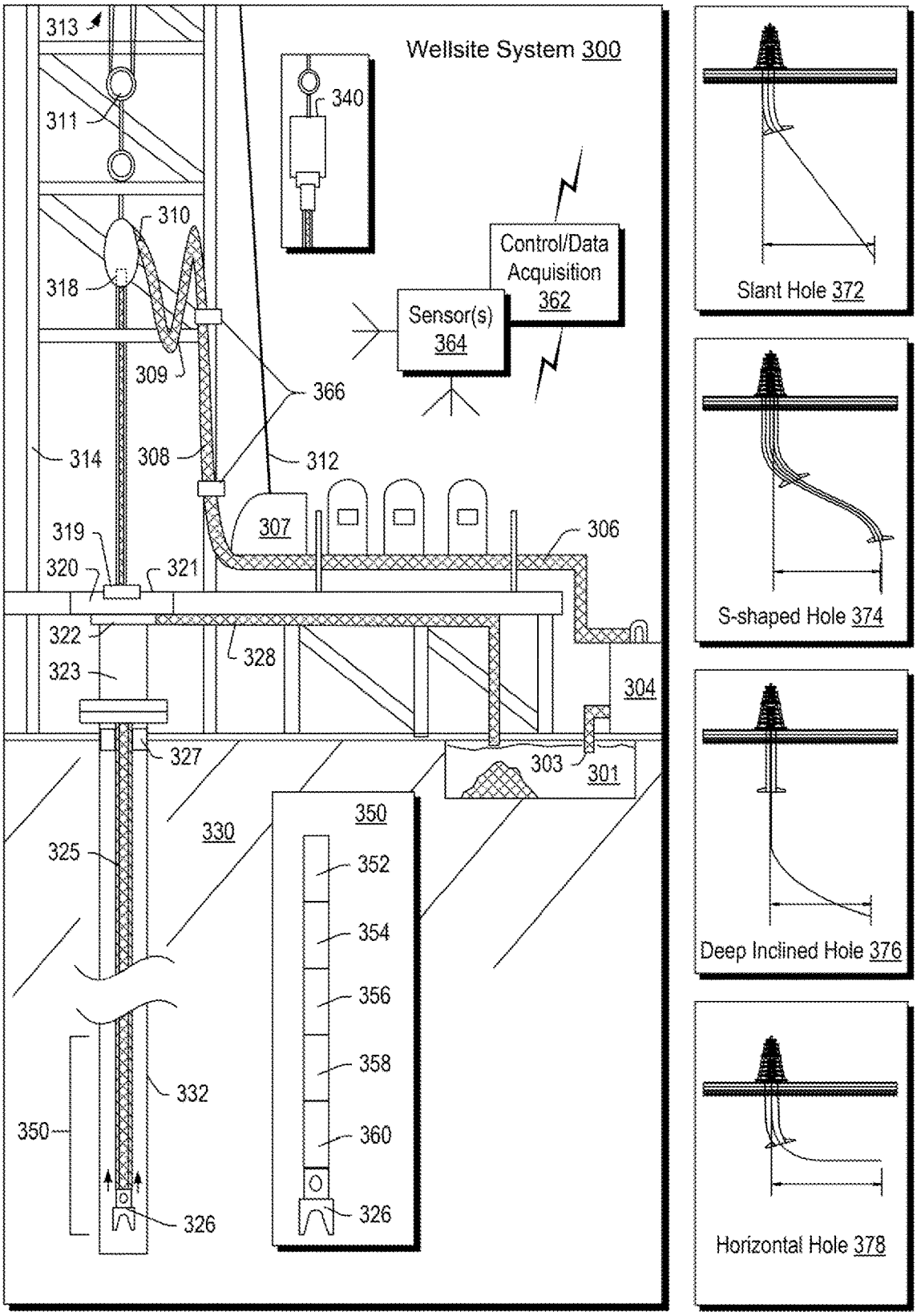
FIG. 3 illustrates an example of a drilling equipment and examples of borehole shapes.

FIG. 3 shows an example of a wellsite system 300 (e.g., at a wellsite that may be onshore or offshore). As shown, the wellsite system 300 can include a mud tank 301 for holding mud and other material (e.g., where mud can be a drilling fluid), a suction line 303 that serves as an inlet to a mud pump 304 for pumping mud from the mud tank 301 such that mud flows to a vibrating hose 306, a drawworks 307 for winching drill line or drill lines 312, a standpipe 308 that receives mud from the vibrating hose 306, a kelly hose 309 that receives mud from the standpipe 308, a gooseneck or goosenecks 310, a traveling block 311, a crown block 313 for carrying the traveling block 311 via the drill line or drill lines 312, a derrick 314, a kelly 318 or a top drive 340, a kelly drive bushing 319, a rotary table 320, a drill floor 321, a bell nipple 322, one or more blowout preventors (BOPs) 323, a drillstring 325, a drill bit 326, a casing head 327 and a flow pipe 328 that carries mud and other material to, for example, the mud tank 301.

In the example system of FIG. 3, a borehole 332 is formed in subsurface formations 330 by rotary drilling; noting that various example embodiments may also use one or more directional drilling techniques, equipment, etc.

As shown in the example of FIG. 3, the drillstring 325 is suspended within the borehole 332 and has a drillstring assembly 350 that includes the drill bit 326 at its lower end. As an example, the drillstring assembly 350 may be a bottom hole assembly (BHA).

The wellsite system 300 can provide for operation of the drillstring 325 and other operations. As shown, the wellsite system 300 includes the traveling block 311 and the derrick 314 positioned over the borehole 332. As mentioned, the wellsite system 300 can include the rotary table 320 where the drillstring 325 pass through an opening in the rotary table 320.

As shown in the example of FIG. 3, the wellsite system 300 can include the kelly 318 and associated components, etc., or the top drive 340 and associated components. As to a kelly example, the kelly 318 may be a square or hexagonal metal/alloy bar with a hole drilled therein that serves as a mud flow path. The kelly 318 can be used to transmit rotary motion from the rotary table 320 via the kelly drive bushing 319 to the drillstring 325, while allowing the drillstring 325 to be lowered or raised during rotation. The kelly 318 can pass through the kelly drive bushing 319, which can be driven by the rotary table 320. As an example, the rotary table 320 can include a master bushing that operatively couples to the kelly drive bushing 319 such that rotation of the rotary table 320 can turn the kelly drive bushing 319 and hence the kelly 318. The kelly drive bushing 319 can include an inside profile matching an outside profile (e.g., square, hexagonal, etc.) of the kelly 318; however, with slightly larger dimensions so that the kelly 318 can freely move up and down inside the kelly drive bushing 319.

As to a top drive example, the top drive 340 can provide functions performed by a kelly and a rotary table. The top drive 340 can turn the drillstring 325. As an example, the top drive 340 can include one or more motors (e.g., electric and/or hydraulic) connected with appropriate gearing to a short section of pipe called a quill, that in turn may be screwed into a saver sub or the drillstring 325 itself. The top drive 340 can be suspended from the traveling block 311, so the rotary mechanism is free to travel up and down the derrick 314. As an example, a top drive 340 may allow for drilling to be performed with more joint stands than a kelly/rotary table approach.

In the example of FIG. 3, the mud tank 301 can hold mud, which can be one or more types of drilling fluids. As an example, a wellbore may be drilled to produce fluid, inject fluid or both (e.g., hydrocarbons, minerals, water, etc.).

In the example of FIG. 3, the drillstring 325 (e.g., including one or more downhole tools) may be composed of a series of pipes threadably connected together to form a long tube with the drill bit 326 at the lower end thereof. As the drillstring 325 is advanced into a wellbore for drilling, at some point in time prior to or coincident with drilling, the mud may be pumped by the pump 304 from the mud tank 301 (e.g., or other source) via the lines 306, 308 and 309 to a port of the kelly 318 or, for example, to a port of the top drive 340. The mud can then flow via a passage (e.g., or passages) in the drillstring 325 and out of ports located on the drill bit 326 (see, e.g., a directional arrow). As the mud exits the drillstring 325 via ports in the drill bit 326, it can then circulate upwardly through an annular region between an outer surface(s) of the drillstring 325 and surrounding wall(s) (e.g., open borehole, casing, etc.), as indicated by directional arrows. In such a manner, the mud lubricates the drill bit 326 and carries heat energy (e.g., frictional or other energy) and formation cuttings to the surface where the mud may be returned to the mud tank 301, for example, for recirculation with processing to remove cuttings and other material.

In the example of FIG. 3, processed mud pumped by the pump 304 into the drillstring 325 may, after exiting the drillstring 325, form a mudcake that lines the wellbore which, among other functions, may reduce friction between the drillstring 325 and surrounding wall(s) (e.g., borehole, casing, etc.). A reduction in friction may facilitate advancing or retracting the drillstring 325. During a drilling operation, the entire drillstring 325 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 326 of the drillstring 325 at a bottom of a wellbore, pumping of the mud commences to lubricate the drill bit 326 for purposes of drilling to enlarge the wellbore. As mentioned, the mud can be pumped by the pump 304 into a passage of the drillstring 325 and, upon filling of the passage, the mud may be used as a transmission medium to transmit energy, for example, energy that may encode information as in mud-pulse telemetry. Characteristics of the mud can be utilized to determine how pulses are transmitted (e.g., pulse shape, energy loss, transmission time, etc.).

As an example, mud-pulse telemetry equipment may include a downhole device configured to effect changes in pressure in the mud to create an acoustic wave or waves upon which information may be modulated. In such an example, information from downhole equipment (e.g., one or more modules of the drillstring 325) may be transmitted uphole to an uphole device, which may relay such information to other equipment for processing, control, etc.

As an example, telemetry equipment may operate via transmission of energy via the drillstring 325 itself. For example, consider a signal generator that imparts coded energy signals to the drillstring 325 and repeaters that may receive such energy and repeat it to further transmit the coded energy signals (e.g., information, etc.).

As an example, the drillstring 325 may be fitted with telemetry equipment 352 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 3, an uphole control and/or data acquisition system 362 may include circuitry to sense pressure pulses generated by telemetry equipment 352 and, for example, communicate sensed pressure pulses or information derived therefrom for process, control, etc.

The assembly 350 of the illustrated example includes a logging-while-drilling (LWD) module 354, a measurement-while-drilling (MWD) module 356, an optional module 358, a rotary-steerable system (RSS) and/or motor 360, and the drill bit 326. Such components or modules may be referred to as tools where a drillstring can include a plurality of tools.

As to a RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling can commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor can present some challenges depending on factors such as rate of penetration (ROP), transferring weight to a bit (e.g., weight on bit, WOB) due to friction, etc. A mud motor can be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM can be determined or estimated as a sum of the SRPM and the mud motor RPM, assuming the SRPM and the mud motor RPM are in the same direction.

The LWD module 354 may be housed in a suitable type of drill collar and can contain one or a plurality of selected types of logging tools. It will also be understood that more than one LWD and/or MWD module can be employed, for example, as represented at by the module 356 of the drillstring assembly 350. Where the position of an LWD module is mentioned, as an example, it may refer to a module at the position of the LWD module 354, the module 356, etc. An LWD module can include capabilities for measuring, processing, and storing information, as well as for communicating with the surface equipment. In the illustrated example, the LWD module 354 may include a seismic measuring device.

The MWD module 356 may be housed in a suitable type of drill collar and can contain one or more devices for measuring characteristics of the drillstring 325 and the drill bit 326. As an example, the MWD tool 354 may include equipment for generating electrical power, for example, to power various components of the drillstring 325. As an example, the MWD tool 354 may include the telemetry equipment 352, for example, where the turbine impeller can generate power by flow of the mud; it being understood that other power and/or battery systems may be employed for purposes of powering various components. As an example, the MWD module 356 may include one or more of the following types of measuring devices: a weight-on-bit measuring device, a torque measuring device, a vibration measuring device, a shock measuring device, a stick slip measuring device, a direction measuring device, and an inclination measuring device.

FIG. 3 also shows some examples of types of holes that may be drilled. For example, consider a slant hole 372, an S-shaped hole 374, a deep inclined hole 376 and a horizontal hole 378.

A drilling operation can include directional drilling where, for example, at least a portion of a well includes a curved axis. For example, consider a radius that defines curvature where an inclination with regard to the vertical may vary until reaching an angle between approximately 30 degrees and approximately 60 degrees or, for example, an angle to approximately 90 degrees or possibly greater than approximately 90 degrees.

A directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As explained, a system may be a steerable system and may include equipment to perform a method such as geosteering. A steerable system can include equipment on a lower part of a drillstring which, just above a drill bit, a bent sub may be mounted. Above directional drilling equipment, a drillstring can include MWD equipment that provides real time or near real time data of interest (e.g., inclination, direction, pressure, temperature, real weight on the drill bit, torque stress, etc.) and/or LWD equipment. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment to follow a desired route to reach a desired target or targets.

A drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

Geosteering can include intentional directional control of a wellbore based on results of downhole geological logging measurements in a manner that aims to keep a directional wellbore within a desired region, zone (e.g., a pay zone), etc. Geosteering may include directing a wellbore to keep the wellbore in a particular section of a reservoir, for example, to minimize gas and/or water breakthrough and, for example, to maximize economic production from a well that includes the wellbore.

Referring again to FIG. 3, the wellsite system 300 can include one or more sensors 364 that are operatively coupled to the control and/or data acquisition system 362. As an example, a sensor or sensors may be at surface locations. As an example, a sensor or sensors may be at downhole locations. As an example, a sensor or sensors may be at one or more remote locations that are not within a distance of the order of approximately one hundred meters from the wellsite system 300.

The system 300 can include one or more sensors 366 that can sense and/or transmit signals to a fluid conduit such as a drilling fluid conduit (e.g., a drilling mud conduit). For example, in the system 300, the one or more sensors 366 can be operatively coupled to portions of the standpipe 308 through which mud flows. As an example, a downhole tool can generate pulses that can travel through the mud and be sensed by one or more of the one or more sensors 366. In such an example, the downhole tool can include associated circuitry such as, for example, encoding circuitry that can encode signals, for example, to reduce demands as to transmission. Circuitry at the surface may include decoding circuitry to decode encoded information transmitted at least in part via mud-pulse telemetry. Circuitry at the surface may include encoder circuitry and/or decoder circuitry and circuitry downhole may include encoder circuitry and/or decoder circuitry. As an example, the system 300 can include a transmitter that can generate signals that can be transmitted downhole via mud (e.g., drilling fluid) as a transmission medium.

Figure 4:
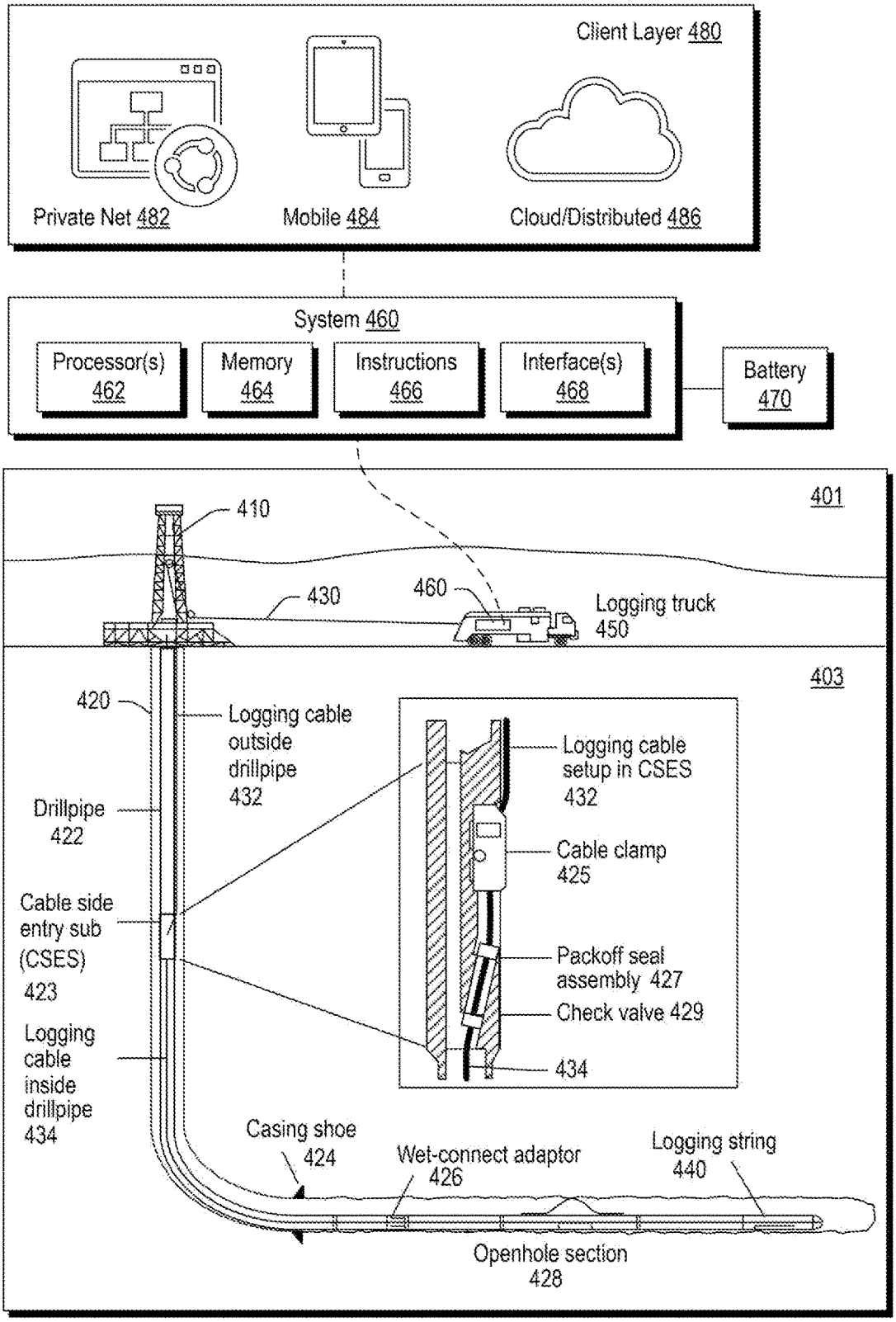
FIG. 4 illustrates an example of a system.

FIG. 4 shows an example of an environment 401 that includes a subterranean portion 403 where a rig 410 is positioned at a surface location above a bore 420. In the example of FIG. 4, various wirelines services equipment can be operated to perform one or more wirelines services including, for example, acquisition of data from one or more positions within the bore 420.

As an example, a wireline tool and/or a wireline service may provide for acquisition of data, analysis of data, data-based determinations, data-based decision making, etc. Some examples of wireline data can include gamma ray (GR), spontaneous potential (SP), caliper (CALI), shallow resistivity (LLS), deep resistivity (LLD and ILD), density (RHOB), neutron porosity (BPHI or TNPH or NPHI), sonic (DT), photoelectric (PEF), permittivity and conductivity.

In the example of FIG. 4, the bore 420 includes drillpipe 422, a casing shoe 424, a cable side entry sub (CSES) 423, a wet-connector adaptor 426 and an openhole section 428. As an example, the bore 420 can be a vertical bore or a deviated bore where one or more portions of the bore may be vertical and one or more portions of the bore may be deviated, including substantially horizontal.

In the example of FIG. 4, the CSES 423 includes a cable clamp 425, a packoff seal assembly 427 and a check valve 429. These components can provide for insertion of a logging cable 430 that includes a portion 432 that runs outside the drillpipe 422 to be inserted into the drillpipe 422 such that at least a portion 434 of the logging cable runs inside the drillpipe 422. In the example of FIG. 4, the logging cable 430 runs past the casing shoe 424 and the wet-connect adaptor 426 and into the openhole section 428 to a logging string 440.

As shown in the example of FIG. 4, a logging truck 450 (e.g., a wirelines services vehicle) can deploy the wireline 430 under control of a system 460. As shown in the example of FIG. 4, the system 460 can include one or more processors 462, memory 464 operatively coupled to at least one of the one or more processors 462, instructions 466 that can be, for example, stored in the memory 464, and one or more interfaces 468. As an example, the system 460 can include one or more processor-readable media that include processor-executable instructions executable by at least one of the one or more processors 462 to cause the system 460 to control one or more aspects of equipment of the logging string 440 and/or the logging truck 450. In such an example, the memory 464 can be or include the one or more processor-readable media where the processor-executable instructions can be or include instructions. As an example, a processor-readable medium can be a computer-readable storage medium that is not a signal and that is not a carrier wave.

FIG. 4 also shows a battery 470 that may be operatively coupled to the system 460, for example, to power the system 460. As an example, the battery 470 may be a back-up battery that operates when another power supply is unavailable for powering the system 460 (e.g., via a generator of the wirelines truck 450, a separate generator, a power line, etc.). As an example, the battery 470 may be operatively coupled to a network, which may be a cloud network. As an example, the battery 470 can include smart battery circuitry and may be operatively coupled to one or more pieces of equipment via a SMBus or other type of bus.

As an example, the system 460 can be operatively coupled to a client layer 480. In the example of FIG. 4, the client layer 480 can include features that allow for access and interactions via one or more private networks 482, one or more mobile platforms and/or mobile networks 484 and via the "cloud" 486, which may be considered to include distributed equipment that forms a network such as a network of networks. As an example, the system 460 can include circuitry to establish a plurality of connections (e.g., sessions). As an example, connections may be via one or more types of networks. As an example, connections may be client-server types of connections where the system 460 operates as a server in a client-server architecture. For example, clients may log-in to the system 460 where multiple clients may be handled, optionally simultaneously.

While the example of FIG. 4 shows the system 460 as being associated with the logging truck 450, one or more features of the system 460 may be included in a downhole assembly, which may be a wireline assembly and/or a LWD assembly. In such an approach, various computations may be performed downhole where results thereof may be optionally transmitted to surface (e.g., to the logging truck 450, etc.) using one or more telemetric technologies and/or techniques (e.g., mud-pulse telemetry, wireline, etc.).

As an example, a method can provide for optimizing downhole formation pressure measurement and sampling using sonic data such as, for example, Stoneley wave data. A Stoneley wave is a type of large-amplitude interface, or surface wave that can be generated by a sonic tool in a borehole. Stoneley waves can propagate along a solid-fluid interface, such as along the walls of a fluid-filled borehole and may be a predominant low-frequency component of signal generated by sonic sources in boreholes. Analysis of Stoneley waves can allow estimation of the locations of fractures and profiles of permeability of the formation.

As an example, a method can include generating mobility data to characterization a formation, for example, at and/or near a borehole wall. Mobility can be defined as a ratio of effective permeability to phase viscosity. Overall mobility can be computed as a sum of individual phase viscosities. Well productivity can in various instances be directly proportional to the product of the mobility and layer thickness. As an example, mobility may be represented as "m", where permeability is represented as "κ" and phase viscosity is represented as "η" such that $m=\kappa/\eta$.

As an example, a method can include generating mobility data by inverting at least Stoneley waveform data (e.g., Stoneley wave data) where the method can use the generated mobility data in a sampling depth optimization process along with petrophysical properties of the formation.

As an example, an inversion may be performed using a method such as, for example, a method described in Kimball et al., "Quantitative Stoneley Mobility Inversion" [QSMI], 1998 SEG Annual Meeting, New Orleans, Louisiana, September 1998. The inversion model of the article by Kimball et al., utilizes a number of parameters, which can include primary and secondary parameters. For example, log mobility can be a primary parameter while borehole fluid slowness, borehole fluid attenuation, log pore fluid modulus, shear slowness, borehole fluid density, log membrane stiffness, hole diameter, formation bulk density, porosity, compressional slowness, formation grain modulus and pore fluid density can be secondary parameters (e.g., ordered with respect to decreasing influence). In Kimball et al., a sonic tool with an 8 receiver array with a 15 cm inter-receiver spacing and SNR of 35 dB was considered. The article by Kimball et al., considered single and two parameter inversions of Stoneley waveforms using maximum likelihood and least mean-squared error processing as a multi-parameter estimator along with a Gaussian window applied to Stoneley wave data (e.g., with a width of approximately 1 ms for a 1.5 kHz to 4.5 kHz processing band).

Stoneley waves, by their nature, tend to be sensitive to mobility of fluid in pore volume of a formation near a wellbore (e.g., a borehole). A permeable formation tends to attenuate the Stoneley wave and increases its slowness at the same time. Such attenuation and increase of slowness are not directly linked to the permeability of the rock, but rather to the change of fluid mobility in permeable zones.

As to slowness, it may also be referred to as an interval transit time, which is the amount of time for a wave to travel a certain distance, proportional to the reciprocal of velocity, as may be measured in microseconds per foot by an acoustic log and symbolized by t or DT. P-wave interval transit times for various sedimentary rock types range from approximately 43 (dolostone) to approximately 160 (unconsolidated shales) microseconds per foot, and can be distinguished from measurements of steel casing, which has a consistent transit time of approximately 57 microseconds per foot.

Being a surface measurement, Stoneley waves are sensitive to borehole condition, such as washouts. A washout can be an enlarged region of a wellbore (e.g., a borehole). A washout in an openhole section is larger than the original hole size or size of the drill bit. Washout enlargement can be caused, for example, by one or more of excessive bit jet velocity, soft or unconsolidated formations, in-situ rock stresses, mechanical damage by BHA components, chemical attack and swelling or weakening of shale as it contacts fresh water. Washouts may become more severe with time. In various instances, appropriate mud types, mud additives and increased mud density can help to minimize washouts.

As to formation pressure measurement and formation fluid sampling, washout intervals tend to be poor regions and may be excluded if such regions (e.g., intervals) are known a priori. As an example, a method can include detecting one or more washout intervals and not performing formation pressure measurements and/or formation fluid sampling in such one or more washout intervals.

Quality of mud cake tends to be a factor for both Stoneley waveform measurement and formation pressure measurement and sampling. As an example, information regarding the mud cake quality can be derived from Stoneley waves and, for example, used to optimize intervals for formation pressure measurement and sampling.

As to mud cake, it may also be referred to as wall cake. Mud cake is a residue deposited on a permeable medium when a slurry, such as a drilling fluid (mud), is forced against the medium under a pressure. Filtrate is the liquid that passes through the medium, leaving the cake on the medium. Drilling muds tend to be tested to determine filtration rate and filter-cake properties. Cake properties such as cake thickness, toughness, slickness and permeability tend to be quite relevant because the cake that forms on permeable zones in a wellbore can cause stuck pipe and/or one or more other types of drilling problems. Reduced oil and gas production can result from reservoir damage when a poor filter cake allows deep filtrate invasion. In various instances, a certain degree of cake buildup can be desirable to isolate formations from drilling fluids. In openhole completions in high-angle or horizontal holes, formation of an external filter cake can be better than a cake that forms partly inside the formation, for example, as the latter may have a higher potential for formation damage.

As an example, inclusion of inverted mobility, borehole condition evaluation, and mud cake quality assessment can enhance confidence in sampling depth selection. As an example, a method can utilize one or more machine learning models (ML models) that utilize Stoneley wave-based mobility to improve interval inclusion and exclusion for purposes of formation pressure measurement and/or formation fluid sampling.

As an example, an automated or semi-automated method can expedite and improve interval selection for measurement and/or sampling. Such a method can be an improvement over workflows that rely on personal expertise to decide what intervals to include and/or exclude. Reliance on personal expertise can introduce user bias and inconsistencies that can impact a selection process. Where intervals are included and/or excluded without assurances, time and resources may be wasted (e.g., consider non-productive time (NPT)) and data may be poor in quality or not representative of bulk formation characteristics. As an example, a method can provide for inclusion and/or exclusion of one or more intervals and, optionally, information as to one or more of permeability, borehole conditions, and mud cake quality.

Figure 5:
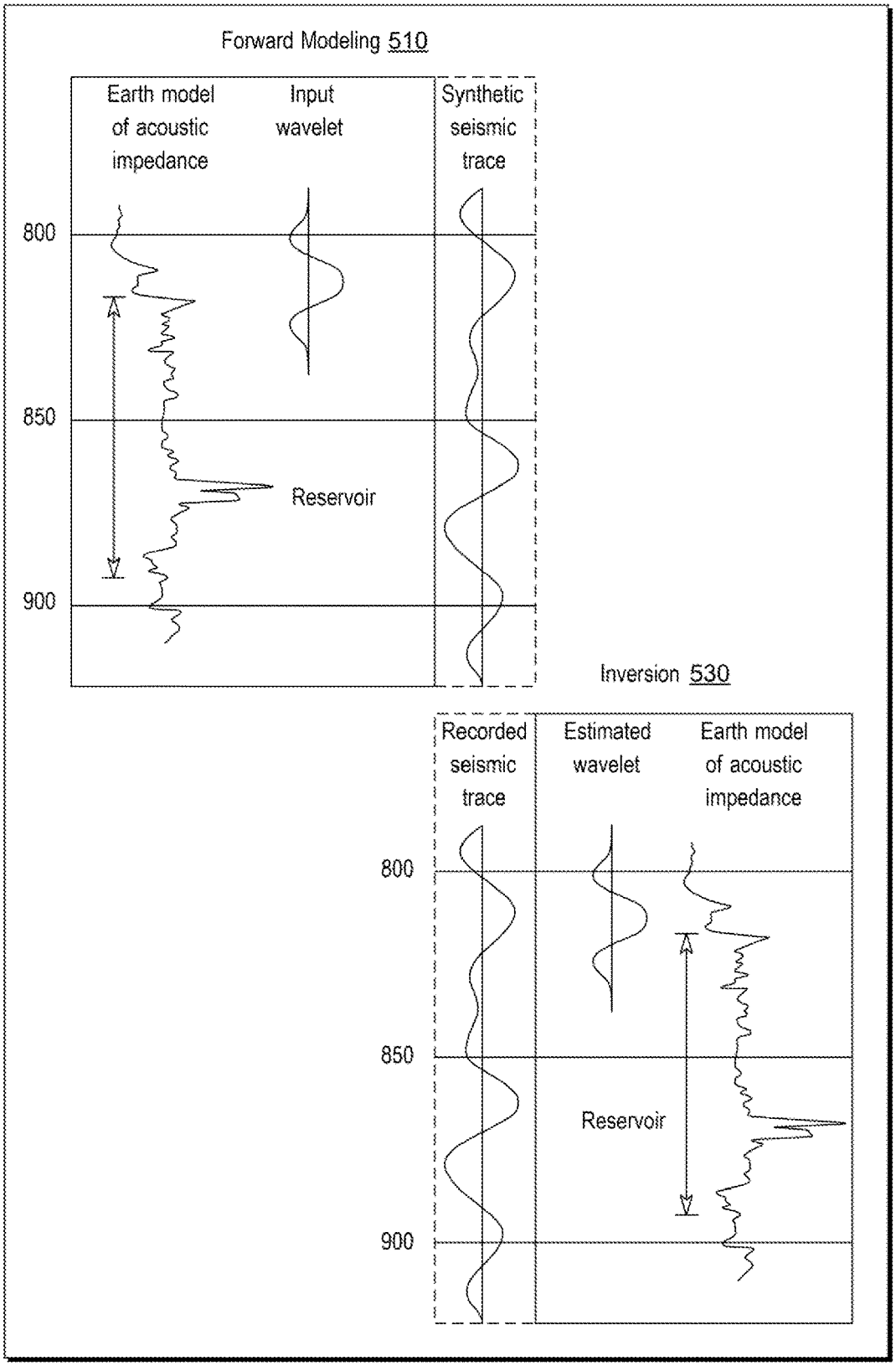
FIG. 5 illustrates an example of forward modeling and an example of an inversion.

FIG. 5 shows an example of forward modeling 510 and an example of inversion 530 (e.g., an inversion or inverting) with respect to seismic data to demonstrate the concept of model-based inversion. As shown, the forward modeling 510 progresses from an earth model of acoustic impedance and an input wavelet to a synthetic seismic trace while the inversion 530 progresses from a recorded seismic trace to an estimated wavelet and an Earth model of acoustic impedance. As an example, forward modeling can take a model of formation properties (e.g., acoustic impedance as may be available from well logs) and combine such information with a seismic wavelength (e.g., a pulse) to output one or more synthetic seismic traces while inversion can commence with a recorded seismic trace, account for effect(s) of an estimated wavelet (e.g., a pulse) to generate values of acoustic impedance for a series of points in time (e.g., depth).

In the example of FIG. 5, acoustic impedance is the opposition of a medium to a longitudinal wave motion. Acoustic impedance is a physical property whose change determines reflection coefficients at normal incidence, that is, seismic P-wave velocity multiplied by density. Acoustic impedance characterizes the relationship between the acting sound pressure and the resulting particle velocity.

During the propagation of seismic wave along a ray path, a seismic wave transmits through or reflects at a material boundary and/or converts its vibration mode between P-wave and S-wave. An observed amplitude of a seismic wave depends on an acoustic impedance contrast at a material boundary between an upper medium and a lower medium. Acoustic impedance (Z) can be defined by a multiplication of density ($\rho$) and seismic velocity (Vp) in each media. Acoustic impedance Z tends to be proportional to Vp for the many sedimentary and crustal rocks (e.g., granite, anorthite, pyrophyllite, and quartzite), except for some ultramafic rocks (e.g., dunite, eclogite, and peridotite) in the mantle.

As to sonic data, it can differ from seismic data such as seismic survey data. As an example, sonic data can include data for formation compressional slowness, for example, based on the transit time between transmitter(s) and receiver(s) positioned in a borehole (e.g., the same borehole). As an example, a wireline sonic measurement can be acquired using an acoustic transducer that emits a sonic signal (e.g., consider a signal within a range of approximately 10 kHz and 30 kHz) that can be detected at two receivers (e.g., farther up the hole). In such an example, the time between emission and reception can be measured for each receiver and subtracted to give the travel time in the interval between the two receivers. If the receivers are two distance units apart, then this time is divided by two to give the interval transit time, or slowness, of the formation (e.g., in units of time over distance). In such an approach, the first arrival at the receiver is a wave that has traveled from the transmitter to the borehole wall, where it has generated a compressional wave in the formation. Some of this wave is critically refracted up the borehole wall, generating head waves in the borehole fluid as it progresses. Some of these strike the receiver, arriving in most instances ahead of other signals traveling directly through the mud. Where a logging tool is parallel to a borehole wall, the traveltime in the mud can be cancelled by taking the difference between the travel time to the two receivers. An irregular hole or a tilted tool may be handled using borehole compensation. As to depth of investigation (DOI), it can depend on the slowness, the transmitter-to-receiver spacing and the presence or absence of an altered zone. DOI can be within an invaded zone and, for example, be of the order of centimeters (e.g., consider up to approximately 10 cm). For sonic measurements such as shear, flexural and Stoneley slownesses and amplitudes, a full waveform may be recorded, for example, using an array-sonic tool and process with a technique such as slowness-time coherence. As an example, one or more sonic measurements can be in the form of a log, which may be referred to as a sonic log. A sonic log may display travel times of various waves versus depth (e.g., measured depth). A sonic log or sonic logs may be recorded by movement of a tool (e.g., LWD, wireline, etc.) in a borehole where, as explained, the tool emits a sound wave or sound waves that travel to a formation and back to a receiver or receivers.

The frequencies for a sonic tool can be higher than those utilized for seismic surveys. A higher frequency can provide for greater resolution, though, with lesser penetration (e.g., greater attenuation of energy). For example, a marine equipment seismic survey may utilize frequencies between approximately 8 Hz and approximately 80 Hz and broadband marine seismic survey systems may utilize frequencies from approximately 2.5 Hz up to approximately 200 Hz. On land, a vibrator (e.g., a truck, etc.) may produce signal frequencies down to approximately 1.5 Hz. Sonic waves in a borehole at 10 kHz propagating in a 5,000 m/s formation have a wavelength of approximately 0.5 m; whereas, seismic survey wavelengths can measure in the tens of meters.

As explained, a sonic log can be acquired by one or more wireline tools (e.g., dipole sonic tool, etc.), one or more coiled tubing tools, and/or one or more LWD tools (e.g., consider the SONIC SCANNER tool, SLB, Houston, Texas) that utilize frequencies that are greater than the frequencies of a seismic survey. As such a sonic log can be of a greater resolution as to a vertical and/or a measured depth (e.g., as a sonic log is a borehole log) when compared to a seismic survey.

As to coiled tubing operations, they can include using continuous relatively small-diameter metal pipe, related surface equipment and, for example, associated drilling, completion and workover, or remediation techniques. Coiled tubing has the capability to drill, convey tools, other equipment, communicate fluid in various types of boreholes (e.g., small diameter, high-angle boreholes, boreholes with other equipment, etc.). In coiled tubing operations, a coiled tubing unit can include a reel from which a continuous length of flexible metal pipe is spooled. To deploy tubing downhole, a coiled tubing operator spools the tubing off the reel and leads it through a gooseneck, which directs the coiled tubing downward to an injector head, where it can be straightened just before it enters the borehole. At the end of an operation, the flexible tubing is pulled out of the well and spooled back onto the reel. As an example, a coiled tubing operation can include a high-pressure swivel joint that enables pumping of fluid through coiled tubing while a reel rotates to spool pipe on or off the reel.

Figure 6:
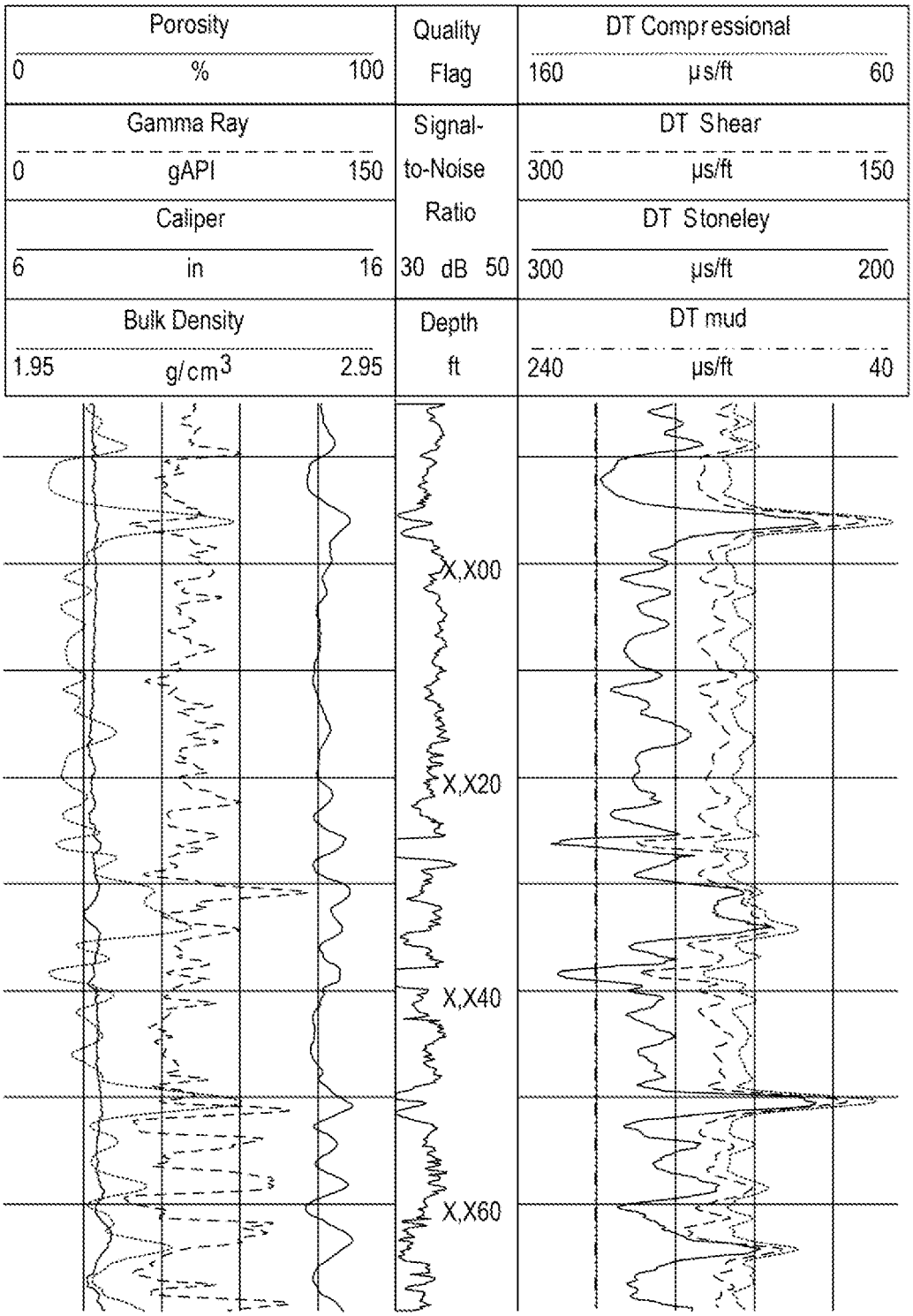
FIG. 6 illustrates examples of logs.

FIG. 6 shows an example plot 600 of various logs as acquired by a tool such as the SONIC SCANNER tool. In a left hand column, porosity in percent, gamma ray in gAPI, caliper in inches, and bulk density in grams per cubic centimeter are shown with respect to depth in feet. In a right hand column, compressional wave slowness, shear wave slowness, Stoneley wave slowness and mud slowness are shown, each in units of microseconds per foot (e.g., note that the scales are from a greater slowness to a lesser slowness in moving from left to right). The sonic slowness data in the plot 600 show variations with respect to depth over a range of approximately 80 feet.

Figure 7:
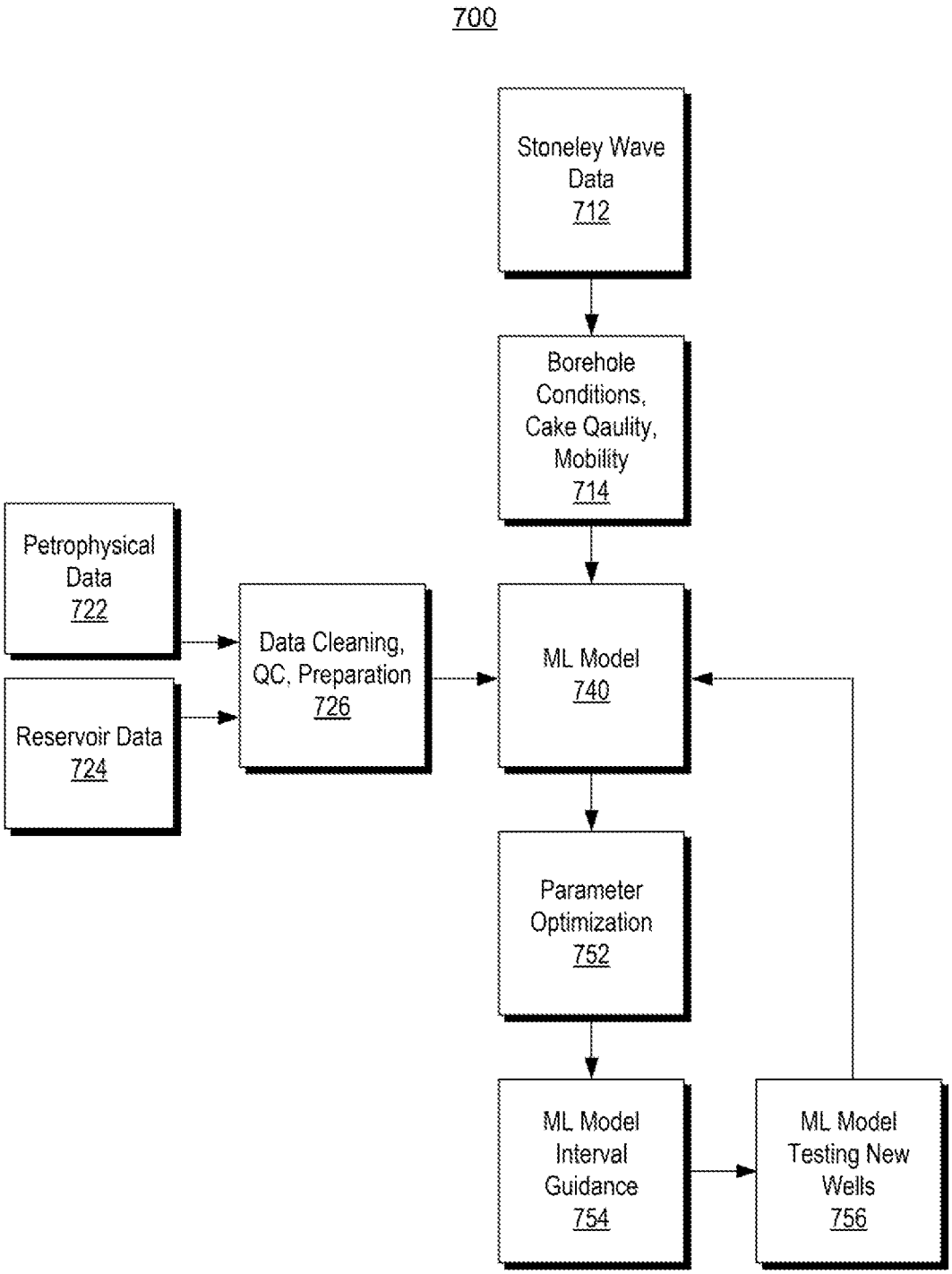
FIG. 7 illustrates an example of a method.

FIG. 7 shows an example of a method 700 that includes a reception block 712 for receiving Stoneley wave data, a determination block 714 for inverting the Stoneley wave data to determine one or more borehole conditions, cake quality and mobility, a reception block 722 for receiving petrophysical data, a reception block 724 for receiving reservoir data, a data processing block 726 for cleaning, quality controlling and preparing data, a ML model block 740 for receiving information from the blocks 714 and 726 and generating output, an optimization block 752 for performing parameter optimization using the output of the ML model block 740, a guidance block 754 for generating ML model-based interval guidance, and a test block 756 for testing the ML model-based interval guidance on one or more new wells. As shown, information generated by the test block 756 may be utilized as feedback for the ML model block 740, for example, to improve the ML model.

In the method 700, examples of a ML model for use in formation sampling depth optimization may include one or more of a gradient-boosting approach (e.g., with customized hyperparameters) and a customized k-fold approach (e.g., hyperparameters customized for data and environment).

Gradient boosting is a machine learning technique used in regression and classification tasks, among others. Gradient boosting can provide a prediction model in the form of an ensemble of weak prediction models, which may be in the form of decision trees.

In gradient boosting, various hyperparameters can be involved. For example, consider one or more of a number of trees or estimators in a model, a learning rate of a model, a row and column sampling rate for stochastic models, a maximum tree depth, a minimum tree weight, regularization terms alpha and lambda, etc. In various instances, one or more hyperparameters may be tuned. For example, consider a process where the learning rate (lambda) is set to as small as possible value followed by tuning the number of trees (iterations or T) using cross validation. Various platforms, libraries, etc., provide default values for hyperparameters. For example, consider the following SCIKIT-LEARN platform hyperparameter values:

learning_rate=0.1 (shrinkage).
n_estimators=100 (number of trees).
max_depth=3.
min_samples_split=2.
min_samples_leaf=1.
subsample=1.0.

Gradient boosting can involve a loss function to be optimized, a weak learner to make predictions, and an additive model to add weak learners to minimize the loss function. The loss function used can depend on the type of problem being solved and can be differentiable. For example, regression may use a squared error and classification may use logarithmic loss. As to a weak learner, decision trees may be used as the weak learner in gradient boosting. For example, regression trees can be used that output real values for splits and whose output can be added together, allowing subsequent models outputs to be added and adjust the residuals in the predictions. As an example, trees may be constructed in a greedy manner, choosing the best split points based on purity scores like Gini or to minimize the loss. As an example, weak learners can be constrained in specific ways, such as a maximum number of layers, nodes, splits or leaf nodes (e.g., to help ensure that the learners remain weak, but can still be constructed in a greedy manner). As to an additive model, trees may be added one at a time, where existing trees in the model are not changed. As an example, a gradient descent procedure can be used to minimize the loss when adding trees. After calculating the loss, to perform the gradient descent procedure, a process can add a tree to the model that reduces the loss (e.g., follow the gradient). Such a process can involve parameterizing the tree, then modify the parameters of the tree and move in the right direction by reducing the residual loss. The output for the new tree is then added to the output of the existing sequence of trees in an effort to adjust or improve the final output of the model. A fixed number of trees can be added or training stopped once loss reaches an acceptable level or no longer improves on an external validation dataset.

As an example, cross-validation can be utilized as a statistical technique to estimate skill of one or more ML models. Cross-validation can be used in applied machine learning, for example, to compare and select a model for a given predictive modeling problem because it is easy to understand, easy to implement, and results in skill estimates that generally have a lower bias than other methods. As an example, a k-fold cross-validation procedure can be implemented for estimating skill of one or more ML models.

More specifically, cross-validation is a resampling procedure that can be used to evaluate one or more ML models on a limited data sample. As to k-fold cross-validation, the parameter k that refers to the number of groups that a given data sample is to be split into (e.g., k-fold). When a specific value for k is chosen, it may be used in place of k in a reference to the model, such as k=10 becoming 10-fold cross-validation.

As explained, cross-validation may be used in applied machine learning to estimate the skill of a ML model on unseen data. That is, to use a limited sample in order to estimate how the ML model is expected to perform in general when used to make predictions on data not used during the training of the ML model.

A k-fold approach can result in a less biased or less optimistic estimate of ML model skill than techniques such as a simple train/test split.

A k-fold approach can include shuffling a dataset randomly, splitting the dataset into k groups where, for each group: (a) take the group as a hold out or test data set; (b) take the remaining groups as a training data set; (c) fit a model on the training set and evaluate it on the test set; and (d) retain the evaluation score and discard the model. In such an example, the k-fold approach can summarize the skill of the model using the sample of model evaluation scores. In such an example, each observation in the data sample can be assigned to an individual group and can stay in that group for the duration of the procedure. This means that each sample is given the opportunity to be used in the hold out set 1 time and used to train the model k−1 times. Accordingly, a k-fold approach involves randomly dividing a set of observations into k groups, or folds, of approximately equal size, where the first fold can be treated as a validation set and where fitting is performed on the remaining k−1 folds.

As an example, a method can include using a gradient boosting model for classification along with a k-fold cross-validation approach. For example, a method that includes evaluating a gradient boosting classifier on a test problem using repeated k-fold cross-validation and reporting mean accuracy. In such an example, a single model may be fit on available data and a single prediction made.

As to Stoneley wave data (see, e.g., the block 712), an acquisition operation may be performed according to one or more standard operating procedures (SOPs) to assure that data are available for one or more regions of interest and that acquired data are of sufficient quality. A SOP may specify one or more factors such as tool speed, acquisition rate, etc. As an example, an acquisition operation may consider position of a tool with respect to a borehole wall. For example, consider tool centralization, which may depend on borehole condition, fluid, tool features, etc. As an example, an acquisition operation may acquire data during one or more periods of time that have relatively low acoustic noise. For example, for a LWD tool, consider acquisition while drilling is halted (e.g., whether mud motor-based or rotary). In such an example, when drilling is halted, the level of acoustic noise may be diminished.

As to acquisition of petrophysical data and/or reservoir data (see, e.g., the blocks 722 and 724), one or more SOPs may be followed to help assure data are of sufficient quality for one or more regions of interest. As indicated in the example of FIG. 7, the method 700 can include processing petrophysical data and/or reservoir data per the block 726, for example, to clean the data, quality control the data, prepare the data, etc.

As to training of a machine learning model (an ML model), consider a method that includes receiving training data that can be utilized for training of a ML model using supervised training. In such an example, the training data can include petrophysical data and/or reservoir data from one or more offset wells (e.g., consider historical data). In the example of FIG. 7, the method 700 shows the ML model block 740 in relationship to output of the block 726. In such an example, the ML model block 740 may be trained using data output by the block 726, which can include processed petrophysical data of the block 722 and/or processed reservoir data of the block 724.

As an example, a trained ML model can include a number of inputs, which may include, for example, one or more of porosity, shale-volume, bulk density, resistivity, calipers and derived Stoneley wave mobility. For example, consider the block 714 of the method 700, which shows a number of inputs as including one or more borehole conditions, cake quality, and mobility, which may be generated via inversion of the Stoneley wave data of the block 712. As an example, inputs to a ML model can include Stoneley wave data, data derived from Stoneley wave data and optionally one or more other types of data. As to output of a ML model, consider a ML model that can output probability and/or success flags for high quality formation testing depths (e.g., testing intervals). As shown in the example of FIG. 7, the method 700 includes the ML model interval guidance block 754, which can be a direct or indirect output of the ML model block 740. For example, consider the ML model block 740 as outputting probabilities for intervals directly or outputting one or more other metrics that can be processed to determine whether an interval is suitable for testing (e.g., sampling) or not. As an example, a metric may relate to one or more factors, where, for example, a factor can be related to Stoneley wave data (e.g., consider mobility, etc.).

As to some examples of inputs, consider porosity as being the percentage of pore volume or void space, or volume within rock that can contain fluids; consider bulk density as being a measurement of the bulk density of a formation, for example, based on a reduction in gamma ray flux between a source and a detector due to Compton scattering; consider resistivity as characterizing an ability of a material to resist electrical conduction (e.g., inverse of conductivity) as measured in ohm-m; consider caliper as being a representation of a measured diameter of a borehole along its depth (e.g., measured depth); consider mobility as being a ratio of effective permeability to phase viscosity; and consider shale volume as being the volumetric fraction of shale in the rock, where shale can be defined as a fine-grained, fissile, detrital sedimentary rock formed by consolidation of clay- and silt-sized particles into thin, relatively impermeable layers.

As explained, a method can include performing an inversion of at least Stoneley wave data to obtain an inverted Stoneley wave-based mobility along with borehole condition evaluation information, and mud cake quality assessment information that can be utilized along with gamma ray, density, neutron porosity, caliper, compressional slowness and photoelectric factor, to determine one or more downhole intervals that are suitable for testing (e.g., sampling). As explained, such a method can utilize a ML model that may be trained using training data and optionally testing data (e.g., in an iterative manner). As explained, petrophysical data and reservoir data (e.g., as to reservoir fluid, etc.) can be subjected to data cleaning and preparation followed by integration of these defined on physical properties of a reservoir-based ML model.

As explained, a ML model may utilize historical learning to predict a sampling depth probability flag. For example, consider using a probability curve that is a function of expected probability of success against a depth log. In such an example, the increased weight on the Stoneley inverted mobility, borehole condition evaluation, and mud cake quality assessment can enhance ML model metrics and amplify the confidence of a prediction.

In the example of FIG. 7, the parameter optimization block 752 can provide for optimization of parameters of the ML model that can be dependent on the physics of a measurement with differential weight to different input. For example, for a new well, the defined petrophysical inputs and Stoneley wave data derived formation and borehole properties can be utilized to generate a predicted depth-based flag to select pressure measurement and sampling depths along with the probability of success of sampling at the selected depth.

As explained, a method can include receiving Stoneley wave data and inverting such data for formation mobility, mud cake quality, and one or more borehole conditions. In such an example, the Stoneley wave data may be organized with respect to depth (e.g., measured depth) in a borehole. As explained, such a method can use Stoneley wave data derived formation and borehole evaluation for determining downhole pressure measurement and sampling depth allocations (e.g., one or more downhole intervals for performing pressure measurement and/or sampling). In various examples, a ML model can be utilized that receives Stoneley wave derived inputs to output one or more metrics for downhole formation pressure measurement and formation fluid sampling depth optimization.

As an example, a framework can be a computational framework that can perform one or more methods. As an example, consider a framework that can receive and/or generate Stoneley waveform-based formation and borehole evaluation information as inputs to a ML model to provide formation pressure measurement and fluid sampling depth in one or more reservoir formations, which can include one or more of clastic, carbonate, tight formations, shale formations, etc.

As an example, a method can utilize Stoneley waveform-based formation and borehole evaluation information with a ML model to provide downhole formation pressure measurement and fluid sampling depth (e.g., measured depth) for horizontal, deviated, and/or vertical wells.

Figure 8:
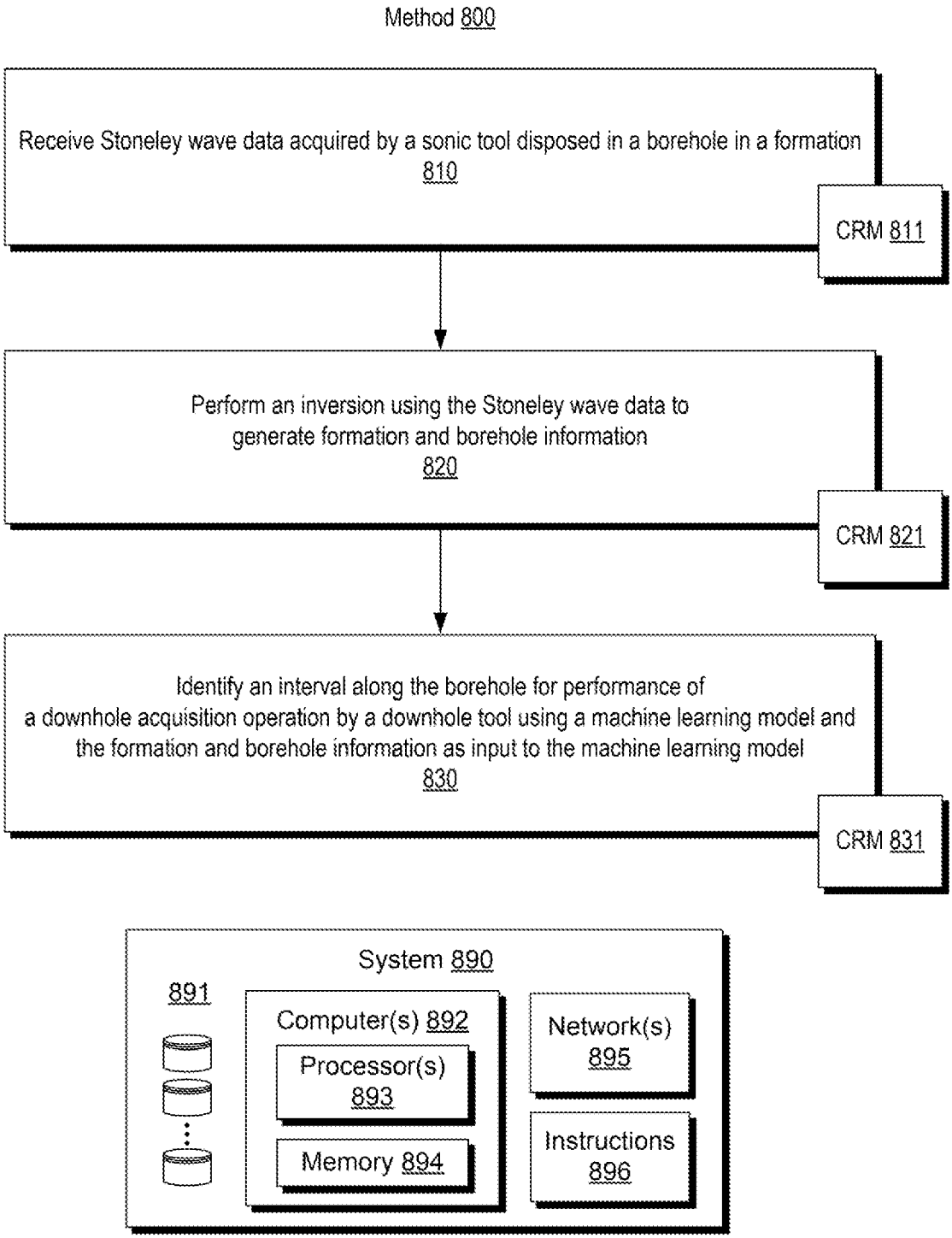
FIG. 8 illustrates an example of a method and an example of a system.

FIG. 8 shows an example of a method 800 and an example of a system 890. As shown, the method 800 can include a reception block 810 for receiving Stoneley wave data acquired by a sonic tool disposed in a borehole in a formation; a performance block 820 for performing an inversion using the Stoneley wave data to generate formation and borehole information; and an identification block 830 for identifying an interval along the borehole for performance of a downhole acquisition operation by a downhole tool using a machine learning model and the formation and borehole information as input to the machine learning model.

The method 800 is shown in FIG. 8 in association with various computer-readable media (CRM) blocks 811, 821 and 831. Such blocks generally include instructions suitable for execution by one or more processors (or processor cores) to instruct a computing device or system to perform one or more actions. While various blocks are shown, a single medium may be configured with instructions to allow for, at least in part, performance of various actions of the method 800. As an example, a computer-readable medium (CRM) may be a computer-readable storage medium that is non-transitory and that is not a carrier wave. As an example, one or more of the blocks 811, 821 and 831 may be in the form of processor-executable instructions.

In the example of FIG. 8, the system 890 includes one or more information storage devices 891, one or more computers 892, one or more networks 895 and instructions 896. As to the one or more computers 892, each computer may include one or more processors (e.g., or processing cores) 893 and memory 894 for storing the instructions 896, for example, executable by at least one of the one or more processors 893 (see, e.g., the blocks 811, 821 and 831). As an example, a computer may include one or more network interfaces (e.g., wired or wireless), one or more graphics cards, a display interface (e.g., wired or wireless), etc.

As to types of machine learning models (ML models), while various examples have been described, one or more ML models may include features of one or more of a support vector machine (SVM) model, a k-nearest neighbors (KNN) model, an ensemble classifier model, a neural network (NN) model, etc. As an example, a machine learning model can be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

As an example, the TENSORFLOW framework (Google LLC, Mountain View, CA) may be implemented, which is an open source software library for dataflow programming that includes a symbolic math library, which can be implemented for machine learning applications that can include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California). As an example, a DATAIKU framework may be utilized (Dataiku, New York, New York).

As an example, a training method can include various actions that can operate on a dataset to train a ML model. As an example, a dataset can be split into training data and test data where test data can provide for evaluation. A method can include cross-validation of parameters and best parameters, which can be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system based platforms.

TENSORFLOW computations can be expressed as stateful dataflow graphs; noting that the name TENSORFLOW derives from the operations that such neural networks perform on multidimensional data arrays. Such arrays can be referred to as "tensors".

As an example, a device may utilize TENSORFLOW LITE (TFL) or another type of lightweight framework. TFL is a set of tools that enables on-device machine learning where models may run on mobile, embedded, and IoT devices. TFL is optimized for on-device machine learning, by addressing latency (no round-trip to a server), privacy (no personal data leaves the device), connectivity (Internet connectivity is demanded), size (reduced model and binary size) and power consumption (e.g., efficient inference and a lack of network connections). Multiple platform support, covering ANDROID and iOS devices, embedded LINUX, and microcontrollers. Diverse language support, which includes JAVA, SWIFT, Objective-C, C++, and PYTHON. High performance, with hardware acceleration and model optimization. Machine learning tasks may include, for example, image classification, object detection, pose estimation, question answering, text classification, etc., on multiple platforms.

As an example, a method can include receiving Stoneley wave data acquired by a sonic tool disposed in a borehole in a formation; performing an inversion using the Stoneley wave data to generate formation and borehole information; and identifying an interval along the borehole for performance of a downhole acquisition operation by a downhole tool using a machine learning model and the formation and borehole information as input to the machine learning model. In such an example, the formation and borehole information can include at least formation mobility where, for example, the formation and borehole information can include mud-cake quality information and/or borehole condition information.

As an example, a machine learning model can output a probability for an interval, where the probability is indicative of the interval being or not being a washout interval.

As an example, a method can include training a machine learning model using one or more of petrophysical data and reservoir data.

As an example, a method can include identifying an interval for a downhole acquisition operation that can be or can include a pressure measurement operation and/or a fluid sampling operation.

As an example, a method can include identifying an interval for performance of more than one downhole acquisition operation. For example, more than one downhole acquisition operation can include a pressure measurement operation and a fluid sampling operation. In such an example, the pressure measurement operation and the fluid sampling operation can be performed using one or more downhole tools on a common tool string or, for example, on separate tool strings.

As an example, a sonic tool can be a tool deployed via a wireline or a coiled tubing or, for example, a sonic tool can be a logging while drilling tool deployed by a drillstring.

As an example, a machine learning model can include at least one decision tree. In such an example, one or more of the at least one decision tree can decide that an interval is probabilistically acceptable for performance of a downhole acquisition operation.

As an example, a machine learning model can include hyperparameters. As an example, a method can include optimizing values of hyperparameters.

As an example, a method can include instructing a downhole tool to perform a downhole acquisition operation.

As an example, a system can include one or more processors; memory accessible to at least one of the one or more processors; processor-executable instructions stored in the memory and executable to instruct the system to: receive Stoneley wave data acquired by a sonic tool disposed in a borehole in a formation; perform an inversion using the Stoneley wave data to generate formation and borehole information; and identify an interval along the borehole for performance of a downhole acquisition operation by a downhole tool using a machine learning model and the formation and borehole information as input to the machine learning model.

As an example, one or more computer-readable storage media can include processor-executable instructions to instruct a computing system to: receive Stoneley wave data acquired by a sonic tool disposed in a borehole in a formation; perform an inversion using the Stoneley wave data to generate formation and borehole information; and identify an interval along the borehole for performance of a downhole acquisition operation by a downhole tool using a machine learning model and the formation and borehole information as input to the machine learning model.

As an example, a computer program product can include one or more computer-readable storage media that can include processor-executable instructions to instruct a computing system to perform one or more methods and/or one or more portions of a method.

Figure 9:
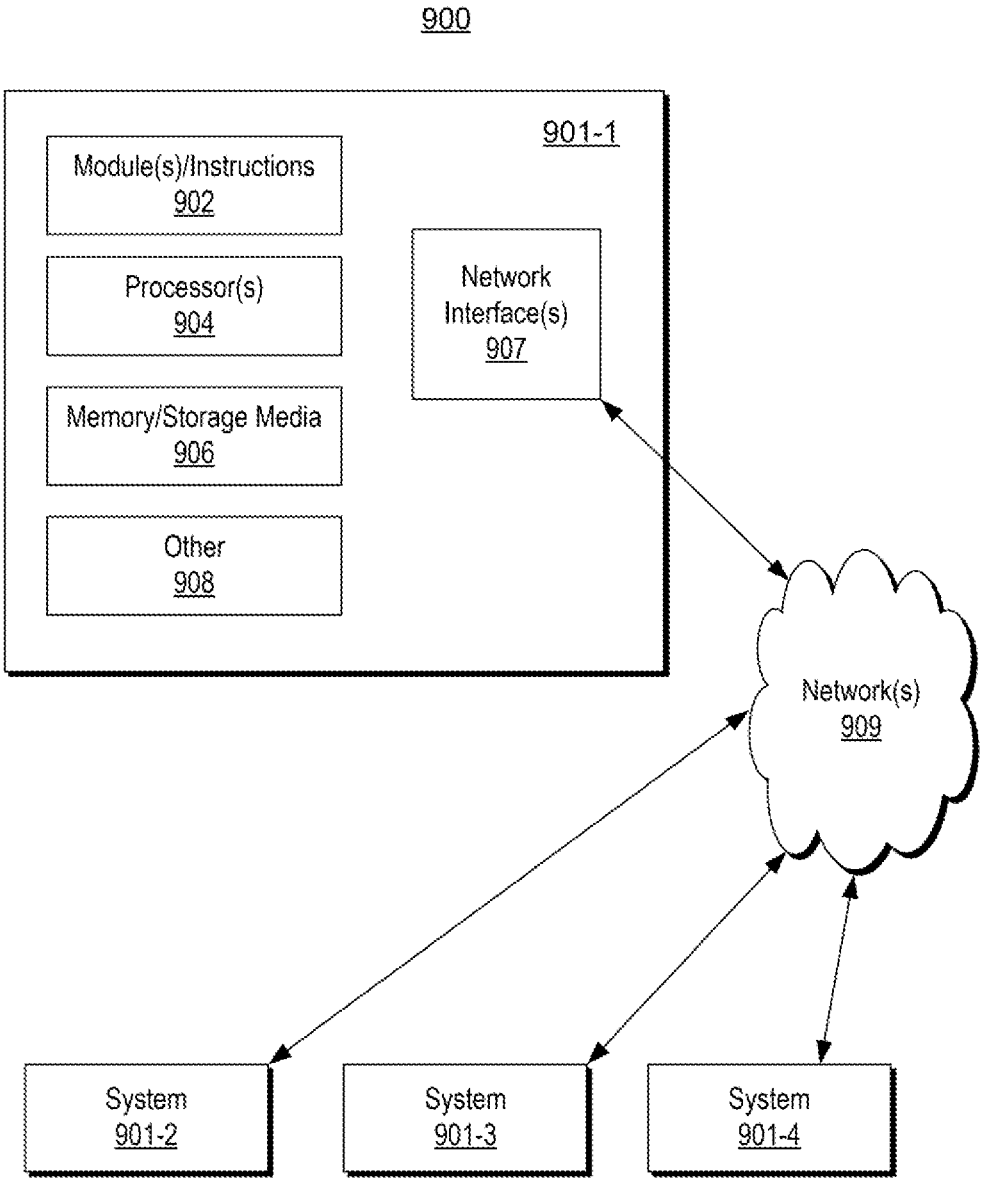
FIG. 9 illustrates examples of computer and network equipment.

In some embodiments, a method or methods may be executed by a computing system. FIG. 9 shows an example of a system 900 that can include one or more computing systems 901-1, 901-2, 901-3 and 901-4, which may be operatively coupled via one or more networks 909, which may include wired and/or wireless networks.

As an example, a system can include an individual computer system or an arrangement of distributed computer systems. In the example of FIG. 9, the computer system 901-1 can include one or more modules 902, which may be or include processor-executable instructions, for example, executable to perform various tasks (e.g., receiving information, requesting information, processing information, simulation, outputting information, etc.).

As an example, a module may be executed independently, or in coordination with, one or more processors 904, which is (or are) operatively coupled to one or more storage media 906 (e.g., via wire, wirelessly, etc.). As an example, one or more of the one or more processors 904 can be operatively coupled to at least one of one or more network interfaces 907; noting that one or more other components 908 may also be included. In such an example, the computer system 901-1 can transmit and/or receive information, for example, via the one or more networks 909 (e.g., consider one or more of the Internet, a private network, a cellular network, a satellite network, etc.).

As an example, the computer system 901-1 may receive from and/or transmit information to one or more other devices, which may be or include, for example, one or more of the computer systems 901-2, etc. A device may be located in a physical location that differs from that of the computer system 901-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 906 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution. As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

transmitting, with a sonic tool disposed in a borehole in a surrounding formation, acoustic signals through an interval of the surrounding formation;

receiving, with the sonic tool, Stoneley wave data of the acoustic signals for the interval from the surrounding formation;

generating interval mobility information, interval mud cake quality information, and interval borehole condition information for the interval through inverse modeling based on the Stoneley wave data;

determining a probability of success for a formation testing operation at the interval using the interval mobility information, the interval mud cake quality information, and the interval borehole condition information as an input to an interval-success machine learning model that is trained based on historical Stoneley wave-based information and training petrophysical and reservoir data to identify a likelihood that pressure measurements and fluid sampling measurements will be successful at a target interval of a target formation; and generating a flag indicating the probability of success for the formation testing operation at the interval.

2. The method of claim 1, wherein the probability of success indicates of the interval being or not being a washout interval.

3. The method of claim 1, comprising training the interval-success machine learning model using the historical Stoneley wave-based information labelled based on the training petrophysical and reservoir data.

4. The method of claim 1, wherein the training petrophysical and reservoir data includes historical pressure measurements corresponding to the historical Stoneley wave-based information.

5. The method of claim 1, wherein the training petrophysical and reservoir data includes historical fluid sampling measurements corresponding to the historical Stoneley wave-based information.

6. The method of claim 1, further comprising:

transmitting acoustic signals and receiving Stoneley wave data for a plurality of intervals of the surrounding formation;

generating interval mobility information, interval mud cake quality information, and interval borehole condition information for each interval of the plurality of intervals through inverse modeling based on the Stoneley wave data for the plurality of intervals; and determining a probability of success for each interval of the plurality of intervals using the interval mobility information, the interval mud cake quality information, and the interval borehole condition information for each interval of the plurality of intervals as inputs to the interval-success machine learning model.

7. The method of claim 6, further comprising generating at least one flag indicating the probability of success for the formation testing operation for at least one interval of the plurality of intervals based on the probability of success for the at least one interval.

8. The method of claim 1, wherein the pressure measurements and the fluid sampling measurements are performed using one or more downhole tools on a common tool string.

9. The method of claim 1, wherein the sonic tool is a tool deployed via a wireline or a coiled tubing.

10. The method of claim 1, wherein the sonic tool is a logging while drilling tool deployed by a drillstring.

11. The method of claim 1, wherein the interval-success machine learning model comprises at least one decision tree.

12. The method of claim 11, wherein one or more of the at least one decision tree decides that the interval is probabilistically acceptable for performing the formation testing operation.

13. The method of claim 1, wherein the interval-success machine learning model comprises hyperparameters.

14. The method of claim 13, further comprising optimizing values of the hyperparameters.

15. The method of claim 1, further comprising instructing a downhole tool to perform the formation testing operation based on the generated flag.

16. A system comprising:

one or more processors;

memory accessible to at least one of the one or more processors;

processor-executable instructions stored in the memory and executable to instruct the system to:

transmit, with a sonic tool disposed in a borehole in a surrounding formation, acoustic signals through an interval of the surrounding formation;

receiving, with the sonic tool, Stoneley wave data of the acoustic signals for the interval from the surrounding formation;

generate interval mobility information, interval mud cake quality information, and interval borehole condition information for the interval through inverse modelling based on the Stoneley wave data;

determine a probability of success for a formation testing operation at the interval using the interval mobility information, the interval mud cake quality information, and the interval borehole condition information as an input to an interval-success machine learning model that is trained based on historical Stoneley wave-based information and training petrophysical and reservoir data to identify a likelihood that pressure measurements and fluid sampling measurements will be successful at a target interval of a target formation; and generating a flag indicating the probability of success for the formation testing operation at the interval.

17. One or more computer-readable storage media comprising processor-executable instructions to instruct a computing system to:

transmit, with a sonic tool disposed in a borehole in a surrounding formation, acoustic signals through an interval of the surrounding formation;

receive, with the sonic tool, Stoneley wave data of the acoustic signals for the interval from the surrounding formation;

generate interval mobility information, interval mud cake quality information, and interval borehole condition information for the interval through inverse modeling based on the Stoneley wave data;

determine a probability of success for a formation testing operation at the interval using the interval mobility information, the interval mud cake quality information, and the interval borehole condition information as an input to an interval-success machine learning model that is trained based on historical Stoneley wave-based information and training petrophysical and reservoir data to identify a likelihood that pressure measurements and fluid sampling measurements will be successful at a target interval of a target formation; and generate a flag indicating the probability of success for the formation testing operation at the interval.

* * * * *